US006048833A

United States Patent [19]

DeGroot

[11] Patent Number: 6,048,833

[45] Date of Patent: Apr. 11, 2000

[54] AZEOTROPE AND AZEOTROPE-LIKE COMPOSITIONS OF 1-BROMOPROPANE AND HIGHLY FLUORINATED HYDROCARBONS

[75] Inventor: Richard J. DeGroot, West Lafayette, Ind.

[73] Assignee: Great Lakes Chemical Corporation, West Lafayette, Ind.

[21] Appl. No.: 09/113,039

[22] Filed: Jul. 9, 1998

Related U.S. Application Data

[60] Provisional application No. 60/052,058, Jul. 9, 1997.

[51] Int. Cl.[7] ..... C11D 7/30; C11D 7/26; C11D 7/50; B08B 3/04

[52] U.S. Cl. ..... 510/412; 510/408; 510/410; 510/411; 252/364; 134/40; 134/42

[58] Field of Search ..... 510/412, 408, 510/410, 411; 252/364; 134/42, 40

[56] References Cited

U.S. PATENT DOCUMENTS

| | | | |
|---|---|---|---|
| 4,652,389 | 3/1987 | Moll | 252/90 |
| 5,064,559 | 11/1991 | Merchant et al. | 252/171 |
| 5,492,645 | 2/1996 | Oshima et al. | 252/171 |
| 5,531,916 | 7/1996 | Merchant | 510/412 |
| 5,792,277 | 8/1998 | Shubkin et al. | 134/19 |
| 5,824,162 | 10/1998 | Clark | 134/31 |

FOREIGN PATENT DOCUMENTS

| | | |
|---|---|---|
| 6-17093 | 1/1994 | Japan . |
| 98/09686 | 3/1998 | WIPO . |
| 99/35210 | 7/1999 | WIPO . |

*Primary Examiner*—Christine Skane
*Attorney, Agent, or Firm*—Woodard, Emhardt, Naughton Moriarty & McNett Patent and Trademark Attorneys

[57] ABSTRACT

This invention provides a solvent composition comprising 1-bromopropane and a decafluoropentane for use as a cleaning and degreasing solvent. Preferably the decafluoropentane consists essentially of 1,1,1,2,3,4,4,5,5,5-decafluoropentane. The solvent composition optionally includes stabilizers and co-solvents such alcohols, ketones, ethers, acetals, nitroalkanes, epoxides and amines. Specific compositions of 1-bromopropane, 1,1,1,2,3,4,4,5,5,5-decafluoropentane and optional stabilizers provide azeotrope compositions that are particularly well suited as cleaning and degreasing solvents.

19 Claims, 1 Drawing Sheet

AZEOTROPE AND AZEOTROPE-LIKE COMPOSITIONS OF 1-BROMOPROPANE AND HIGHLY FLUORINATED HYDROCARBONS

REFERENCE TO RELATED APPLICATION

This application claims priority to a co-pending United States Provisional Application Ser. No. #60/052,058, filed on Jul. 9, 1997 by Richard J. DeGroot.

FIELD OF THE INVENTION

This invention relates to a cleaning solvent comprising a highly-fluorinated hydrocarbon and 1-bromopropane and to a method of cleaning articles. More particularly, this invention is directed to a solvent composition that includes 1,1,1,2,3,4,4,5,5,5-decafluoropentane, 1-bromopropane, and optionally stabilizers and co-solvents, and to a method of cleaning articles having cloth, plastic, metallic and ceramic surfaces.

BACKGROUND OF THE INVENTION

There is a demand to find new solvents to replace chlorofluorocarbons (CFC's) and hydrochlorofluorocarbons (HCFC's). These solvents typically have been used in a wide variety of applications including cleaning and degreasing solvents for the metal, textile and electronic industries, as flame retardants and heat transfer mediums for refrigeration processes. In recent years use of these solvents has been restricted because of concern over environmental hazards, particularly in light of the link between use of these solvents and the destruction of the atmospheric ozone layer. Highly fluorinated hydrofluorocarbons (HFC's) are considered to be viable alternatives for CFC's and HCFC's in many applications. The HFC's are chemically stable, nontoxic, nonflammable and less hazardous to the environment then either CFC's or HCFC's. However. HFC's are not considered to be as effective cleaning and degreasing solvents as the CFC's and HCFC's. Highly fluorinated hydrocarbons (HFC's) have a low solvating ability when compared with CFC's and HCFC's, and HFC's are not as efficacious as CFC's and HCFC's for dissolving greases and oils or disbursing other undesirable materials such as flux and flux residues on printed circuit boards. It has been determined that HFC's can be combined with other organic solvents to provide a cleaning solution having higher solvating ability. The added organic solvent must be carefully selected so the resulting cleaning and degreasing solvent maintains its desirable physical and chemical properties such as low toxicity, low boiling, environmentally friendly and nonflammable. Furthermore while a particular solvent mixture initially may provide the desired physical and chemical characteristics in bulk, i.e. non-toxic, low boiling, nonflammable and high solvating ability, in practice, the mixture may be inadequate.

Most solvent mixtures partition during use, especially when the solvent is heated during the cleaning process or during solvent recovery. Partitioning of the mixture provides a solvent that is deficient in one or more of its constituents. The resulting solvent does not have the same properties as the original solvent. For example, solvents are often heated to boiling to vaporize the solvent composition in a vapor defluxing or degreasing system. The vaporized solvent condenses on components such as circuit boards that are inserted into the system. When partitioning occurs, the composition of the vaporized solvent differs from the liquid solvent in the solvent reservoir. Partitioning results in a solution that can detrimentally affect the safety and efficacy of the cleaning operation. It is advantageous to provide non-partitioning solvents to ensure safe and effective cleaning and degreasing processes.

It is also advantageous to minimize partitioning during solvent recovery to improve efficiency and decrease costs. Solvents are often recovered by distilling used or contaminated solutions to provide essentially pure solvents that can be reused. Partitioning during recovery requires that one or more of the original components be added to the recovered solvent to maintain the original solvent composition.

SUMMARY OF THE INVENTION

The present invention provide a solvent compositions that include a highly fluorinated hydrochlorofluorocarbon (HFC) and 1-bromopropane useful as cleaning and degreasing solvents. The solvent composition optionally includes stabilizers and co-solvents. The stabilizers and co-solvents include alcohols, ketones, ethers, acetals, nitroalkanes, epoxides, amines, and saturated and unsaturated hydrocarbons. When the certain highly fluorinated hydrocarbons and 1-bromopropane are admixed in specific proportions, they form azeotropic mixtures. While the azeotropic mixtures are a preferred composition, non-azeotropic mixtures are considered to lie within the scope of the present invention. The most preferred composition for the present invention is an azeotropic composition comprising 1,1,1,2,3,4,4,5,5,5-decafluoropentane and 1-bromopropane. The solvent composition optionally includes stabilizers and co-solvents. The solvent compositions comprising HFC's and 1-bromopropane provide non-azeotrope and azeotrope or azeotrope-like compositions that are well suited for solvent-cleaning applications.

The present invention also provides a method for cleaning an article having a cloth, ceramic, plastic or metallic surface using the solvent compositions comprising 1-bromopropane and a highly fluorinated hydrocarbon. The solvent is applied to the article's surface by any of the known or conventional methods to clean and degrease grease, oils and particulate matter adhering to the article's surface. Removal of the contaminated solvent provides a cleaned article that is suitable for subsequent processing or forwarding to consumers.

BRIEF DESCRIPTION OF THE DRAWING

The FIG. 1 is a plot of 1,1,1,2,3,4,4,5,5,5-decafluoropentane concentrations by weight of the composition in the liquid and vapor phases obtained during distillation of the solvent composition.

DETAILED DESCRIPTION OF THE INVENTION

Figure 1:
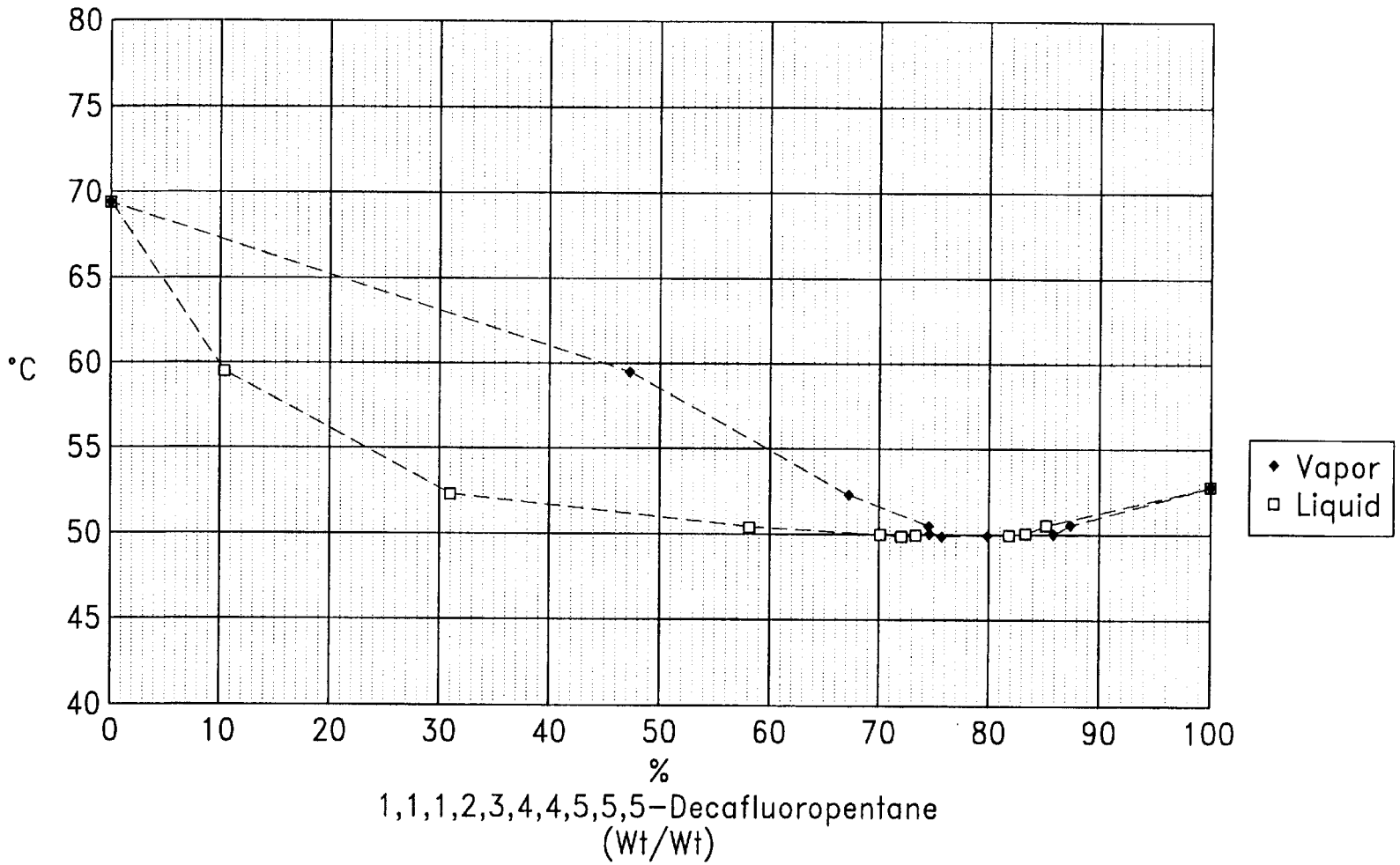

The present invention is directed to a solvent composition comprising 1-bromopropane and a highly fluorinated hydrocarbon for use as a cleaning and degreasing solvent. Preferably the highly fluorinated hydrocarbon is a highly fluorinated pentane. Optionally, the solvent composition includes stabilizers and co-solvents such as alcohols, ketones, ethers, acetals, nitroalkanes, epoxides, amines, and saturated and unsaturated hydrocarbons. Furthermore, the solvent composition comprises an azeotrope or azeotropic-like composition that consists essentially of 1-bromopropane and a highly fluorinated pentane. This azeotrope solvent composition provides a constant boiling solvent that does not partition upon evaporation or distillation. While the azeotrope and azeotrope-like composition are preferred, the non-azeotrope composition comprising 1-bromoproane and a highly fluorinated pentane are still considered to be within the scope of the invention. Use of the solvent prepared according to this invention cleans a wide variety of articles having cloth, ceramic, metallic, and plastic surfaces.

For the proposes of this invention, an azeotrope composition is defined as a constant boiling liquid admixture of two or more substances that exhibits physical characteristics of a single compound, in that the vapor, produced by partial evaporation or distillation of the liquid, has substantially the same composition as the liquid, i.e., the admixture distills without substantial change in the composition. Constant boiling compositions, which are characterized as azeotropes, exhibit either a maximum or minimum boiling point as compared with that of the non-azeotropic mixtures of the same substances. The present invention contemplates the admixture of the highly fluorinated pentane, 1-bromopropane, and optionally one or more stabilizers and co-solvents in an azeotrope mixture.

By azeotrope-like compositions it is meant that a composition of compounds has a concentration that may vary, however minor, from the concentrations found in the azeotropic compositions. Thus the concentrations of the highly fluorinated pentane, 1-bromopropane, and added stabilizers and co-solvents included in an azeotrope-like composition may vary somewhat from the concentrations found in the azeotrope formed between them and remain a composition within the scope of this invention. The boiling points of the azeotrope-like compositions will be substantially the same as those of their corresponding azeotropes. Preferably, the azeotrope-like compositions boil, at ambient pressure, at temperatures that are within about 2° C. of the temperatures at which their corresponding azeotropes boil at the same pressure.

Furthermore, compositions of highly fluorinated pentane, 1-bromopropane and additional stabilizers and co-solvents that, when fractionally distilled, provide a distillate that is an azeotrope or an azeotrope-like composition when the concentrations of the highly fluorinated pentane, 1-bromopropane and added stabilizers and co-solvents differ from the concentrations of the azeotrope or azeotrope-like compositions are within the scope of this invention. Preferably, the concentrations of the highly fluorinated pentane, 1-bromopropane, and added stabilizers and co-solvents of such compositions differ from the concentration of the azeotrope or azeotrope-like composition by no more than about 10%. more preferably, no more than about 5% by weight.

By solvating ability is meant the characteristic of a composition in the liquid state to dissolve solid or semi-solid matter and become miscible with liquids including gums, greases and gels. On a molecular level, solvation entails dispersing molecules of the matter with solvent molecules. The dissolution and miscibility does not have to be complete, i.e. infinite solubility or miscibility with the matter. However, it is understood that increasing the amount of the solvent composition added to the substrate or by repeated application of essentially non-contaminated solvent successively solubilizes more of the matter with each increase in solvent amount or each successive application of essentially non-contaminated solvent. One method of evaluating a solvent's solvating ability is to measure its Kauri Butanol value as described in ASTM Dl 133-94 Standard Test Method for Kauri Butanol Value of Hydrocarbon Solvents.

The solvent composition of the present invention comprises a highly fluorinated pentane. Preferably the highly fluorinated pentane is a decafluoropentane having a boiling point of 55° C. at atmospheric pressure, more preferably the decafluoropentane consists essentially of 1,1,1,2,3,4,4,5,5,5-decafluoropentane. This decafluoropentane is commercially available under the trade name Vertrel XF from Dupont. Preferably the solvent composition of the present invention is a azeotrope composition consisting essentially of 1,1,1,2,3,4,4,5,5,5-decafluoropentane and 1-bromopropane having about 84.7% by weight 1,1,1,2,3,4,4,5,5,5-decafluoropentane and about 15.3% by weight 1-bromopropane and a boiling point of about 49.2° C. at atmospheric pressure.

The solvent composition also includes 1-bromopropane, which is commercially available from Great Lakes Chemical Corporation. This halogenated solvent is low boiling, inexpensive and considered less harmful to the atmospheric ozone layer than chlorofluorocarbons. Importantly, 1-bromopropane is non-toxic, unlike many other halogenated alkanes; for example, 2-bromopropane is considered to be extremely toxic to both humans and animals. Furthermore, 1-bromopropane has an extremely high solvating ability as is exemplified by its Kauri Butanol Value of 125.

While 1-bromopropane provides an excellent cleaning solvent for metal components, its high solvating ability limits its application for plastics and elastomers; 1-bromopropane tends to etch or partially dissolve plastic surfaces. Admixtures of 1-bromopropane with less aggressive solvents such as hydrochlorofluorocarbons reduces this detrimental effect on plastics and elastometers while at the same time it increases the solvating ability of the hydrochlorofluorocarbons. The final solvent blend is highly effective for cleaning a wide variety of articles having metal, ceramic, cloth and plastic surfaces.

The solvent composition comprises decafluoropentane and 1-bromopropane in concentrations other than the azeotropic concentrations, but when these solvent compositions are fractionally distilled, they provide azeotrope compositions. Preferably the concentrations of the decafluoropentane and 1-bromopropane differ from the concentrations of the azeotrope or azeotrope-like composition by no more than about 10%, more preferably no more than about 5% by weight.

Solvent compositions that do not provide azeotrope compositions upon distillation are also included in present invention. Non-azeotrope solvent compositions are useful for certain applications where partitioning of the cleaning solvent is not a major consideration. The non-azeotropic solvent composition comprises 1-bromopropane and about 1% to about 99% of a highly fluorinated pentane, preferably about 10% to about 90% by weight, more preferably about 30% to about 70% by weight of a highly fluorinated pentane.

Admixture of 1-bromopropane and a highly fluorinated pentane provides a solvent composition with a high solvating ability. By judicious selection of the solvent composition, a cleaning solution having a solvating ability that is lower than 1-bromopropane yet higher than the highly fluorinated pentane can be prepared. The solvent of the present invention comprises about 1% to about 99% by weight 1-bromopropane, preferably about 10% to about 90% by weight, more preferably about 30% to about 70% by weight 1-bromopropane. The solvent compositions of the present invention provide cleaning solvents that have a Kauri Butanol Value of about 6 to about 124, preferably about 25 to about 105. and more preferably about 35 to about 95.

Optionally, the solvent composition includes stabilizers and co-solvents. These stabilizers and co-solvents are included to modify the physical and chemical characteristics of the solvent composition. The stabilizers are added to inhibit metal induced decomposition of halogenated hydrocarbons. Often reactive metals such as aluminum, magnesium, copper, zinc, iron, titanium, tin and alloys of these metals induce decomposition of halogenated hydrocarbons such as 1-bromopropane. Typically, these metals induce hydrolysis and/or dehydrohalogenation of the alkyl halides to provide metal halides, halide salts and acids as some of the decomposition species. Generation of these decomposition species is harmful to metal components. Metal bromides and some of the metal salts are formed from metal ions abstracted from the metal surface, and the hydrobromic acid severely corrodes metals further exacerbating the problem. Thus, added stabilizers stabilize halogenated solvents in both the liquid and vapor state against deterioration in the presence of these metals, inhibit formation of complexes of the metal and decomposition products of the solvent, and reduce attack upon the metal by some of these decomposition products. Stabilizers that are included as optional components of the solvent composition include alcohols, ketones, ethers, acetals, nitroalkanes, epoxides, amines, and mixtures of these stabilizers.

Examples of alcohols that can be added to the solvent include, but are not limited to: ethyl alcohol, propyl alcohol, isopropyl alcohol, t-butyl alcohol, t-amyl alcohol, sec-butyl alcohol, phenols, e.g. phenol, p-cresol, m-cresol, o-cresol, amino alcohols, e.g. monoethanol amine, diethanol amine, triethanol amine, acetylene alcohols, e.g. methylbutynol, methylpentynol, benzotriazol, and mixtures of alcohols.

Typical ketones useful in the present invention include: acetone, methyl ethyl ketone (MEK), 2-propanone (diethyl ketone), 2-pentanone, 3-pentanone, 2-hexanone, 3-hexanone, 2-heptanone, 3-heptanone, 4-heptanone, 2,6-dimethyl -4-heptanone, 2-methyl-3-heptanone, 2-methyl-2-butanone, 2-methyl-3-pentanone, 2-nonanone, and mixtures of ketones.

Specific examples of ethers that can be added to the stabilized solvent include: diethyl ether, dipropyl ether, dibutyl ether, methyl t-butyl ether, 1,4 dioxane, 1,3 dioxalane, trioxane, y-butyrolactone, tetrahydrofuran, dialkyl ethers of ethylene glycol, e.g. dimethyl ethylene glycol ether, diethyl ethylene glycol ether, and monoalkyl ethylene glycol ethers sold under the trade name CELLOSOLVE that have from 1 to 10 carbons such as methyl cellosolve, ethyl cellosolve, and isopropyl cellosolve. These ethers are added singly or as mixtures of two or more to the solvent.

Examples of acetals suitable for the present invention include dimethyl and diethyl acetals of the ketones listed above.

Typical nitroalkanes useful in the present invention include: nitromethane, nitroethane, 1-nitropropane, 2-nitropropane, nitrobutane, and mixtures of nitroalkanes.

Specific examples of epoxides useful with the present invention include: epibromohydrin, propylene oxide, 1,2-butylene oxide, 2,3-butylene oxide, cyclohexene oxide, glycidyl methyl ether, glycidyl methacrylate, pentene oxide, cyclopentene oxide, and cyclohexene oxide. The epoxides are added to the stabilized solvent either singly or as a mixture of two or more.

Non-nucleophilic amines are preferred, and therefore secondary and tertiary amines are desired. By way of example, amines useful for the present invention include: hexylamine, octylamine, 2-ethylhexylamine, dodecylamine. ethylbutylamine, hexylmethylamine, butyloctylamine, dibutylamine, octadecylmethylamine, triethylamine, tributylamine, diethyloctylamine, tetradecyldimethylamine, dibutylamine; diisobutylamine, diisopropylamine, pentylamine, N-methylmorpholine, isopropylamine, cyclohexylamine, butylamine, isobutylamine, dipropylamine, 2,2,6,6-tetramethylpiperidine, N,N-dimethyl-p-phenylamine, N,N-diethyl-p-phenylamine, diethylamine, aniline, ethylenediamine, propylenediamine, triethylamine, tetraethylenepentamine, benzylamine, dibenzylamine, diphenylamine, and diethylhydroxyamine. These amines are useful either singly or as a combination of two or more.

Examples of co-solvents include: alkanes, alkenes, alkynes, alcohols, ketones, esters, terpenes and various aliphatic mixtures including mineral spirits, VM&P Naptha and Stoddard solvents. Many of the stabilizers listed above are also considered to be co-solvents. The co-solvents are added to modify the solvating ability of the solvent composition. Thus, for example, alcohols and ketones can be added to attenuate the solvating ability of the 1bromopropane. Co-solvents also provide a higher degree of polarity and hydrogen bonding characteristics to the solvent, which enables the solvent to effectively remove ionic or polar contaminates. Furthermore, these co-solvents are often less expensive than the highly fluorinated pentanes, and they reduce the costs associated with preparing and using the solvent blend.

The solvent composition is prepared by the admixture of the 1-bromopropane and a sufficient amount of the highly fluorinated pentane to provide the desired cleaning solvent having a specified concentration or a desired Kauri Butanol Value. The order of addition of the components is not critical for this invention. When desired the stabilizers and co-solvents are added. In addition, minor amounts of surfactants can be included. Typical surfactants useful for the invention include ionic and non-ionic surface active agents, for example, sulfonate salts, phosphate salts, carboxylate salts, fatty acids, alkyl phenols, glycols, esters and amides. Surface active agents also include ionic and non-ionic water displacement compounds such as tetraalkyl ammonium sulfonate, phosphate, and carboxylate and bromide salts, aliphatic amino alkanols, fluorinated amino alkanols, and chlorofluorinated amino alkanols. Again the order of addition is not critical for the present invention.

The solvent composition of the present invention is suitable for washing articles having cloth, metal, ceramic, plastic and elastomeric surfaces. The solvent composition may be applied by any method known or commonly used to clean or degrease articles. For example, the surface of the article may be wiped with an absorbent medium containing the solvent composition such as a cloth saturated with the solvent. The article may be submerged or partially submerged in a dip tank. The solvent in a dip tank can be either hot or cold, and the article can be submerged for extended periods of time without inducing decomposition of the solvent. Furthermore, the article, dip tank, and related components are not harmed by the process. Alternatively, the solvent can be sprayed onto the article or the article can be cleaned in a vapor degreasing chamber with either liquid or vaporized solvent composition.

When the solvent is applied as a vapor, the solvent is typically heated in a solvent reservoir to vaporize the solvents. The vaporized solvent then condenses on the surface of the article. The condensed solvent solvates or entrain grease, oil. dirt, and other undesirable particles that are on the article's surface. The contaminated solvent drains into the solvent reservoir carrying the dissolved and entrained material to the reservoir. Since only the solvent is vaporized, the grease, oil, and dirt remain in the reservoir, and the article is continually flushed with non-contaminated solvents.

The following examples further illustrate the present invention and are not intended to be limiting in any manner.

EXAMPLE 1

Decafluoropentane and 1-Bromopropane Azeotrope Composition

A vapor liquid diagram for 1-bromopropane and decafuoropentane was developed by mixing various concentrations of these solvents. The solvent compositions were distilled in a 100 ml Othmer Still. The solvent was heated to reflux and allowed to equilibrate. Samples of the vapor and liquid portions were taken and analyzed using a gas chromatograph to determine the concentrations of the components. The results are listed in Table 1 and graphically illustrated in FIG. 1. Analysis of the results indicated that an azeotrope composition exists consisting of 1-bromopropane and 1,1,1,2,3,4,4,5,5,5decafluoropentane.

TABLE 1

| Temperature ° C. | Liquid Wt % DFP | Vapor wt % DFP |
|---|---|---|
| 50.3 | 58.0 | 74.5 |
| 52.2 | 31.0 | 67.22 |
| 59.5 | 10.4 | 47.25 |
| 49.9 | 70.0 | 74.53 |
| 49.8 | 73.3 | 75.60 |
| 49.8 | 72.0 | 75.04 |
| 49.8 | 81.8 | 79.72 |
| 49.8 | 83.3 | 85.80 |
| 50.4 | 85.2 | 97.40 |
| 52.8 | 100.0 | 100.0 |
| 69.4 | 0.0 | 0.0 |

DFP = 1,1,2,3,4,4,5,5,5-Decafluoropentane

Based upon these initial results, a second solvent composition consisting of about 81.2% by weight 1,1,1,2,3,4,4,5,5,5-decafluoropentane and about 17.8% by weight 1-bromopropane was prepared. This second solvent mixture was distilled in a Perkin Elmer Model 151 Annular Still, (200 theoretical plate capacity). After the refluxing solvent had equilibrated, distillate fractions comprising approximately 10% by weight of the total liquid charge were collected at a 10:1 reflux to takeoff ratio. The boiling point of each fraction was measured to the nearest 0.1° C. The concentrations of 1-bromopropane and 1,1,1,2,3,4,4,5,5,5-decafluoropentane fractions were determined using a gas chromatograph. The results of this second distillation are listed in Table 2. Analysis of the results listed in Table 2 confirms that an azeotrope exists having about 15.3% 1-bromopropane by weight and approximately 84.7% by weight 1,1,1,2,3,4,4,5,5,5-decafluoropentane; and that the azeotrope boils at about 80.2° C.

TABLE 2

| Cut # | Wt (g) | % Distilled | Wt % DFP | Wt % n-PBr |
|---|---|---|---|---|
| Initial | 86.2 | 0 | 81.2 | 17.8 |
| Forerun | | | 88.49 | 11.51 |
| 1 | 7.2 | 8 | 85.65 | 14.35 |
| 2 | 10.5 | 21 | 85.68 | 14.32 |

TABLE 2-continued

| Cut # | Wt (g) | % Distilled | Wt % DFP | Wt % n-PBr |
|---|---|---|---|---|
| 3 | 9.4 | 31 | 85.78 | 14.22 |
| 4 | 12.7 | 46 | 83.27 | 16.73 |
| 5 | 12.1 | 60 | 83.28 | 16.72 |
| 6 | 9.9 | 72 | 90.19 | 9.81 |
| 7 | 11.2 | 85 | 97.19 | 2.81 |
| Bottoms | 7.2 | 93 | 100.63 | 0 |
| Average (Cuts 1–5) | | | 84.73 | 15.27 |

DFP = 1,1,1,2,3,4,4,5,5,5-defluoropentane, n-PBr = 1-bromopropane

EXAMPLE 2

Solvent Composition Comprising 1,1,1,2,3,4,4,5,5,5-Decafluoropentane, 1-Bromopropane and Isopropyl Alcohol A solvent composition comprising about 33% by weight 1,1,1,2,3,4,4,5,5,5-decafluoropentane, about 33% by weight 1-bromopentane, and about 33% by weight isopropyl alcohol was prepared. As an initial screening evaluation, 100 g of this solvent mixture was fractionally distilled in a Perkin Elmer Annular Still model 151 (200 theoretical plate capability). The solvent was heated to reflux and allowed to equilibrate. Three distillate fractions were collected at a 10:1 reflux to takeoff ratio. The concentrations of 1,1,1,2,3,4,4,5,5,5-decafluoropentane and isopropyl alcohol were determined for each fraction using a gas chromatograph. The results are listed in Table 3. Analysis of the results indicates that the solvent composition partitioned when distilled. Despite partitioning, this solvent composition performs well as a cleaning and degreasing solvent in applications were solvent partitioning is not a concern.

TABLE 3

| Fractions | Wt % DFP | Wt % IPA |
|---|---|---|
| Initial | 33.0 | 33.0 |
| 1 | 79.1 | 1.7 |
| 2 | 74.4 | 1.8 |
| 3 | 62.3 | 5.1 |
| Bottoms | 2.3 | 61.3 |

Boiling point = 50 ° C., DFP = 1,1,1,2,3,4,4,5,5,5-decafluoropentane, IPA = isopropyl alcohol

EXAMPLE 3

1Bromopropane, 1,1,1,2,3,4,4,5,5,5-Decafluoropentane and Methanol Azeotrope Composition.

A solvent composition comprising equal weight amounts of 1-bromopropane, 1,1,1,2,3,4,4,5,5,5-decafluoropentane and methanol was prepared. One hundred grams of this solvent composition was distilled in a Perkin Elmer Still model 151 (200 theoretical plate capacity). The solvent mixture was heated to reflux and allowed to equilibrate before three ten-gram fractions were collected; the concentrations of 1,1,1,2,3,4,4,5,5,5-decafluoropentane, 1-bromopropane and methanol were determined in each fraction using a gas chromatograph. Minimal separation was observed in this preliminary distillation. Based upon the results of the initial distillation, a second solvent composition was prepared. This second composition was distilled as described above. Distillate fractions, each approximately 10% by weight of the total solvent weight were collected at a 10:1 reflux to takeoff ratio. The compositions of the distillate fractions were then analyzed, using a gas chromatography and the compositional data and boiling points for the distillation are listed in Table 4. Analysis of the results listed in Table 4 confirms that minimal separation occurred between the three components during the distillation and that an azeotrope exists. The azeotrope consists essentially of about 80.8% by weight 1,1,1,2,3,4,4,5,5,5-decafluoropentane, about 5.7% by weight methanol and about 13.6% by weight 1-bromopropane, and has a boiling point of about 50° C.

TABLE 4

| Cut # | wt | Wt % DFP | Wt % methanol | Wt % n-PB |
|---|---|---|---|---|
| Forerun | 5.5 | 81.48 | 5.62 | 10.9 |
| 1 | 11.8 | 82.21 | 5.37 | 12.42 |
| 2 | 12.2 | 78.76 | 5.58 | 15.66 |
| 3 | 14.3 | 79.61 | 5.61 | 14.78 |
| 4 | 12.2 | 79.44 | 5.73 | 14.83 |
| 5 | 12.2 | 81.36 | 5.86 | 12.78 |
| 6 | | 83.13 | 5.94 | 10.93 |
| | | 92.24 | 5.15 | 2.61 |
| Average 1–6 | | 80.8 | 5.7 | 13.6 |

DFP = 1,1,1,2,3,4,4,5,5,5-decafluoropentane, n-PB = 1-bromopropane

EXAMPLE 4

1,1,1,2,3,4,4,5,5,5-Decafluoropentane, 1-Bromopropane, and Acetone Azeotrope Composition A solvent composition comprising equal amounts by weight of 1,1,1,2,3,4,4,5,5,5-decafluoropentane, 1-bromopropane, and acetone was prepared. The resulting solution was fractionally distilled in a Perkin Elmer Annular Still model 151 as described in Example 2 to initially determine if the three components form an azeotrope composition. Based upon the results of the initial evaluation, a second solvent blend comprising about 32.5% by weight 1,1,1,2,3,4,4,5,5,5-decafluoropentane, 29.9% by weight 1-bromopropane, and about 37.4% by weight acetone was prepared. This second solvent composition was fractionally distilled in the Perkin Elmer still. After the solvent was heated to reflux and allowed to equilibrate, distillate fractions of approximately 10% by weight based upon the total solvent were collected at a 10:1 reflux to takeoff ratio. Each distillate fraction was analyzed using a gas chromatograph to determine the concentrations of each of the components. The results are tabulated in Table 5.

TABLE 5

| Cut # | Wt (g) fractions | Wt % Distilled | Wt % DFP | Wt % Acetone | Wt % n-PB |
|---|---|---|---|---|---|
| Initial | 94.3 | 0 | 32.5 | 37.4 | 29.9 |
| Forerun | 2.8 | | 34.4 | 38.46 | 27.14 |
| 1 | 7.2 | 8 | 33.04 | 42.6 | 24.36 |
| 2 | 4.5 | 13 | 27.33 | 45.62 | 27.05 |
| 3 | 10.0 | 24 | 26.6 | 45.41 | 27.99 |
| 4 | 7.7 | 32 | 26.66 | 44.09 | 29.25 |
| 5 | 7.6 | 40 | 28.28 | 43.57 | 28.15 |
| 6 | 7.8 | 49 | 28.59 | 41.63 | 29.78 |
| 7 | 8.4 | 58 | 30.18 | 39.74 | 30.08 |
| 8 | 6.9 | 66 | 32.95 | 39.37 | 27.68 |
| 9 | 8.0 | 74 | 34.86 | 34.59 | 30.55 |
| 10 | 10.4 | 86 | 37.9 | 30.97 | 31.13 |
| | 12.4 | 99 | 53.88 | 26.7 | 19.42 |
| Average (Cuts 1–8) | | | 29.2 | 42.8 | 28.0 |

DFP = 1,1,1,2,3,4,4,5,5,5-decafluoropentane, n-PB = 1-bromopropane

EXAMPLE 6

1,1,1,2,3,4,4,5,5,5-Decafluoropentane, 1-Bromopropane, Isopropyl Alcohol, and Nitromethane Solvent Blend A solvent composition comprising about 32% by weight 1,1,1,2,3,4,4,5,5,5-decafluoropentane, about 32% by weight 1-bromopropane, about 32% by weight isopropyl alcohol, and about 4% by weight nitromethane was prepared and distilled as described in Example 2. The results of the distillation are listed in Table 7.

TABLE 7

| Fractions | wt % DFP | wt % IPA | wt % Nitromethane |
|---|---|---|---|
| Initial | 32 | 82.4 | 4 |
| 1 | 80.8 | 32.0 | 0 |
| 2 | 78.0 | 1.7 | 0 |
| 3 | 79.8 | 1.8 | 0 |
| Bottoms | 12.0 | 49.5 | 5.5 |

DFP = 1,1,1,2,3,4,4,5,5,5-decafluoropentane, IPA = isopropyl alcohol

Analysis of the results does not confirm that an azeotrope composition exists for this solvent composition comprising approximately equal amounts by weight of 1,1,1,2,3,4,4,5,5,5-decafluoropentane, 1-bromopropane, isopropyl alcohol and about 4% by weight nitromethane. This solvent mixture provides a good cleaning and degreasing solvent for operations where partitioning is not a concern.

What is claimed is:

1. A solvent composition comprising 1-bromopropane and about 1% to about 99% by weight of a hydrofluorocarbon consisting essentially of 1,1,1,2,3,4,4,5,5,5-decafluoropentane.

2. The composition of claim 1 comprising about 10% to about 90% by weight of the hydrofluorocarbon.

3. The composition of claim 2 comprising about 30% to about 70% by weight of the hydrofluorocarbon.

4. The composition of claim 1 comprising about 1 1% to about 17% by weight 1-bromopropane and about 83% to about 90% by weight hydrofluorocarbon.

5. The composition of claim 1 having a Kauri Butanol value of about 5 to about 125.

6. The composition of claim 1 further comprising a stabilizer selected from the group consisting of alcohols, ketones, nitroalkanes, epoxides, amines, ethers, and mixtures thereof.

7. The composition of claim 6 wherein the stabilizer is a $C_1$ to $C_5$ alcohol.

8. The composition of claim 7 comprising about 12% to about 16% by weight of 1-bromopropane, about 78% to about 84% by weight of hydrofluorocarbon, and about 5% to about 6% by weight methanol.

9. The composition of claim 7 comprising about 20% to about 25% by weight 1-bromopropane, about 70% to about 80% by weight hydrofluorocarbon and about 1% to about 5% by weight 2-propanol.

10. The composition of claim 6 wherein the stabilizer is a ketone.

11. The composition of claim 10 comprising about 24% to about 31% by weight 1-bromopropane, about 26% to about 35% by weight hydrofluorocarbon, and about 35% to about 46% by weight acetone.

12. The composition of claim 6 comprising about 15% to about 25% by weight 1-bromopropane, about 65% to about 75% by weight hydrofluorocarbon, and about 5% to about 15% by weight butylene oxide.

13. A method of cleaning an article, said method comprising the step of contacting the article with a solvent composition comprising 1-bromopropane and about 1% to about 99% by weight of a hydrofluorocarbon consisting essentially of 1,1,1,2,3,4,4,5,5,5-decafluoropentane.

14. The method of claim 13 wherein the solvent composition comprises about 10% to about 90% by weight hydrofluorocarbon.

15. The method of claim 14 wherein the solvent composition comprises about 30% to about 70% by weight hydrofluorocarbon.

16. The method of claim 14 wherein the solvent composition further comprises a stabilizer selected from the group consisting of alcohols, ketones. nitroalkanes, epoxides, amines, ethers, and mixtures thereof.

17. An azeotrope or azeotrope-like composition consisting essentially of, in weight percent, about 14.22% to about 16.73% 1-bromopropane and about 83.27% to about 85.78% 1,1,1,2,3,4,4,5,5,5-decafluoropentane, wherein the composition has a boiling point at atmospheric pressure of about 80.2° C.

18. An azeotrope or azeotrope-like composition consisting essentially of, in weight percent, about 78.76% to about 83.13% 1,1,1,2,3,4,4,5,5,5-decafluoropentane, about 12.42% to about 15.66% 1-bromopropane and about 5.37% to about 5.94% methanol wherein said composition has a boiling point at atmospheric pressure of about 50° C.

19. An azeotrope or azeotrope-like composition consisting essentially of, in weight percent, about 26.6% to about 33.04% 1,1,1,2,3,4,4,5,5,5-decafluoropentane, 24.36% to about 30.08% 1-bromopropane, and about 39.37% to about 45.62% acetone.

* * * * *

UNITED STATES PATENT AND TRADEMARK OFFICE

CERTIFICATE OF CORRECTION

PATENT NO. : 6,048,833
DATED : April 11, 2000
INVENTOR(S) : DeGroot

It is certified that error appears in the above-identified patent and that said Letters Patent is hereby corrected as shown below:

Column 1,
Line 36, please delete "then" and insert in lieu thereof -- than --.

Column 4,
Line 7, please delete "a" and insert in lieu thereof -- an --.

Column 6,
Line 22, please delete "1bromopro-" and insert in lieu thereof -- 1-bromopro --.

Column 7,
Line 39, please delete "1,1,2,3,4,4,5,5,5" and insert in lieu thereof
-- 1,1,1,2,3,4,4,5,5,5 --.

Column 8,
Line 33, please delete "were" and insert in lieu thereof -- where --.

Signed and Sealed this

Twenty-fifth Day of December, 2001

*Attest:*

*Attesting Officer*

JAMES E. ROGAN
*Director of the United States Patent and Trademark Office*